United States Patent [19]

Mueller et al.

[11] 4,141,195

[45] Feb. 27, 1979

[54] METHOD AND APPARATUS FOR FORMING A TAMPER-PROOF CLOSURE FOR A CONTAINER

[75] Inventors: Martin Mueller, Wonderlake; David St. Clair, Wilmette, both of Ill.

[73] Assignee: Owens-Illinois, Inc., Toledo, Ohio

[21] Appl. No.: 826,004

[22] Filed: Aug. 19, 1977

Related U.S. Application Data

[63] Continuation of Ser. No. 575,537, May 8, 1975, abandoned.

[51] Int. Cl.[2] ..... B65B 61/18

[52] U.S. Cl. ..... 53/412; 53/419; 53/133; 53/139.3

[58] Field of Search ..... 53/14, 42, 133, 211, 53/136, 212, 139.3; 270/69; 83/337; 156/187, 199, 204, 227, 447, 458, 459, 468; 215/246, 232, 274, 250; 93/1 TS, 36 B, 36 DA; 206/628, 633

[56] References Cited

U.S. PATENT DOCUMENTS

| | | | |
|---|---|---|---|
| 2,205,127 | 6/1940 | Spiess | 270/69 |
| 2,553,877 | 5/1951 | Smith et al. | 83/133 |
| 3,324,625 | 6/1967 | Dulmage | 53/42 |
| 3,396,899 | 8/1968 | Strouse et al. | 206/633 X |
| 3,555,764 | 1/1971 | Dowling | 53/139.3 X |
| 3,577,293 | 5/1971 | Ritterhoff | 53/211 X |
| 3,676,271 | 7/1972 | Hake et al. | 53/139.3 X |
| 3,755,033 | 8/1973 | Emus | 156/459 X |
| 3,851,443 | 12/1974 | Fine | 53/139.3 |
| 3,873,018 | 3/1975 | Donnay | 53/139.3 |
| 3,905,859 | 9/1975 | Patterson | 156/458 |

*Primary Examiner*—John Sipos

*Attorney, Agent, or Firm*—Myron E. Click; Harold F. Mensing

[57] ABSTRACT

A method and apparatus for forming a heat-sprinkable secondary closure for a container are disclosed, wherein filled, lidded containers moved by conveyor means are delivered to a secondary closure formation and application station, where a band of heat-shrinkable thermoplastic adhesive tape is wrapped around each container such that the tacky side of the tape faces the container, with tape overlapping the seam formed between the periphery of the lid and the sidewall of the container. The tape band is severed from the tape supply during wrapping, and heater means located adjacent the container shrinks the tape into compressive engagement with the periphery of the lid and the sidewall of the container as the tape is wrapped thereabout. Integral gripping tabs are formed at spaced positions in the tape prior to wrapping of the tape band and shrinking thereof, and once the band is shrunk into tight adhesive engagement with the container, the tab is positioned near an outer overlapping end of the band to provide convenient means for removal of the tape from the container. The end of the tape beyond the gripping tab is adhesively secured to an underlying portion of the band to retain the gripping tab in place.

16 Claims, 20 Drawing Figures

TO VAC. SOURCE 9.
8A.
14.

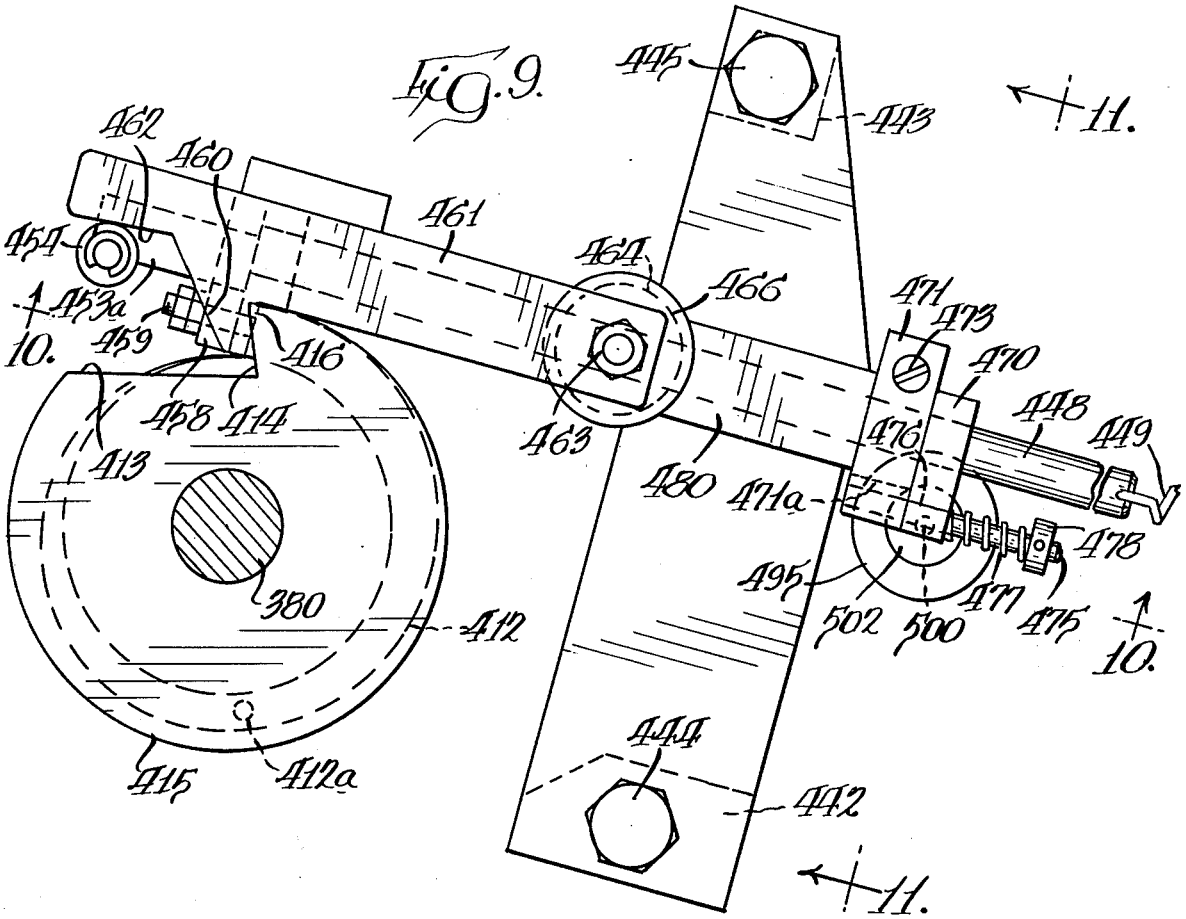
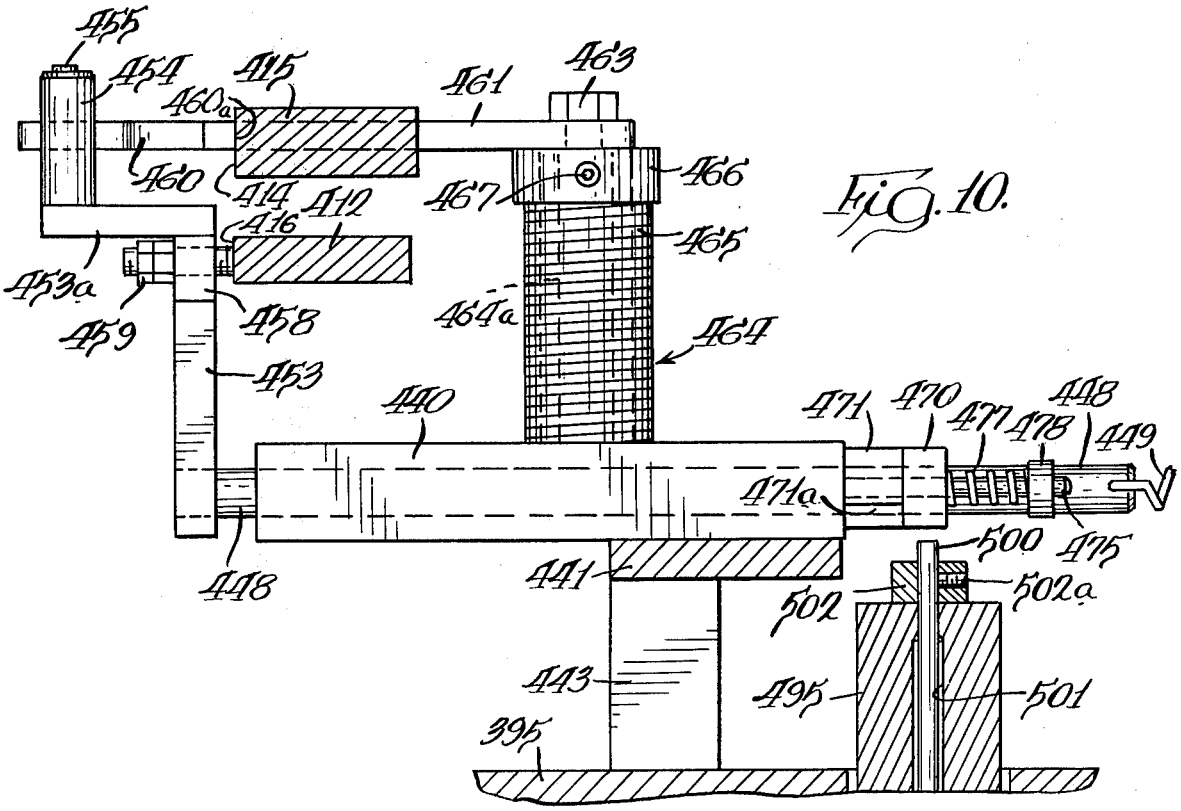
Fig. 10.

METHOD AND APPARATUS FOR FORMING A TAMPER-PROOF CLOSURE FOR A CONTAINER

This is a Continuation of application Ser. No. 575,537 filed May 8, 1975, now abandoned.

BACKGROUND OF THE INVENTION

This application is related to concurrently filed Mueller application Ser. No. 575,536 entitled "Tamper-Proof Closure For A Container" now U.S. Pat. No. 3,997,056.

Individual sealed containers in various sizes, shapes and forms have become increasingly popular in packaging numerous products, particularly of the flowable type. Special types of fully automated packaging equipment have been developed that are capable of taking nestable type containers from a stack and transferring them to a conveyor which moves the containers along a predetermined path where upon they are filled at a filling station and subsequently covers are applied to the containers at a cover applying station. Conventional containers used with the aforesaid automatic filling equipment typically utilize open-topped rimmed containers sealed by covers pressfitted over the rim portion of the container body. These containers are readily adaptable to mechanical handling and are easy to open and close. However, because of the relative ease with which the containers can be opened, they are also prone to open accidentally during handling and shipment. To counter this problem, it is desirable in some instances to provide a secondary closure on the containers to reduce the possibility of accidental opening during handling and shipment, and in addition, to deter tampering with the contents.

In the recent past, it has become known to package filled frusto-conically shaped containers in an alternately inverted array, so that the containers are positioned in internested, mutually supporting relationship with respect to one another. This packaging practice has increased the danger of leakage, particularly from those containers that are inverted. Thus, there is a significant need for positive, leak proof closure system for the individual containers that are packaged in alternately inverted fashion.

Secondary closures for containers are well known in the art as evidenced, for example, by U.S. Pat. Nos. 2,057,061, 2,269,621, 3,358,902, 3,555,764, 3,827,591, and German Pat. No. 1,186,797. Previous secondary closures typically consisted of a covering positioned around the container to additionally secure the closure to the container body. Many of these secondary closures function adequately, but are objectionable to the consumer because they required the use of a tool, such as a knife, to remove them. Certain known secondary closures shown in the above mentioned patents are in the form of strips secured around the container and left with a loose end which functions as a gripping tab for removal. The disadvantage with this arrangement however, is that the loose end is susceptible to snagging or pulling, causing premature opening of the secondary closure. One known secondary closure disclosed in the above mentioned patents also has material from a separate strip wrapped about a loose end to form a gripping tab. Formation of this secondary closure is unduly complicated because of the use of separate strips to form the gripping tab.

With the foregoing in mind, there is a need for a secondary closure for a container adapted for use with automatic filling equipment that can easily be removed by a consumer, and which is protected against accidental opening.

SUMMARY OF THE INVENTION

The present invention is directed toward a method and apparatus for providing an improved secondary closure for open-top, rimmed containers having lids seated within the open-top thereof. The method and apparatus of the present invention is particularly well adapted for use with existing high speed, automatic filling equipment for simultaneously packaging flowable products in multiple rows of containers and sealing such containers.

In accordance with one aspect of the present invention, filled open-top containers having lids seated within the open-tops are intermittently moved along a path to a secondary closure station where they are moved into tangential relationship with a tape wrapping member. Heat shrinkable thermoplastic tape is guided around the tape wrapping member, with the tape having a non-adhesive or non-tacky side against the tape wrapping member and an adhesive or tacky side facing a container. The tape is intermittently fed from a continuous supply of tape, and is wrapped around the perimeter of the container so that is bridges the seam formed by the intersection of the periphery of the lid and the container sidewall. The tape is severed from the supply so that its length is sufficient when wrapped around the container, to slightly overlap. The tape is subjected to heat as it is being wrapped, which shrinks the tape into tight adhesive engagement with both the sidewall and lid of the container, forming a fluid tight seal. In addition, during dwell portions of the intermittent tape feed, integral gripping tabs are formed at spaced locations along the length of the tape leading from the tape supply. The tab spacing is selected such that each tab will be positioned a short distance from the free overlapping end of the tape wrapped around each container. The tab extends outwardly of the container to provide a means for easily removing the tape from the container and the free end of the tape adhesively anchors the tab in place until the container is to be opened.

The tape is drawn from the tape supply by a tape feed assembly, and guided through a tape guide channel to the wrapping member, which releasably holds the tape thereon by vacuum applied to the non-adhesive surface of the tape. In a preferred embodiment of the invention, the container is circular in cross-section, as is the tape wrapping member, which has the tape trained about the periphery thereof. Each lidded container is raised into side-by-side tangential alignment with the wrapping member, where the container is engaged by a continuously revolving container driving assembly which causes the cup to rotate. When the container initially moves into the raised position, the tape on the tape wrapping member is spaced from but adjacent to the container at the level of the seam formed by the intersection of the periphery of the lid and the container sidewall. Engagement of the container driving assembly by the container activates a one revolution clutch mechanism which connects a drive mechanism to the wrapping member, causing the tape wrapping member to revolve. During rotation, the vacuum on the tape is released and the adhesive surface of the tape on the tape wrapping member moves into contact with the container, causing the tape to be transferred to the container so that it bridges the aforesaid seam. A source of heated air is positioned adjacent the container driving assembly and heated air is directed at the container rim to shrink the tape on the container as it is rotated.

The gripping tab is formed by applying suction to the non-adhesive side of the tape when feeding of the tape is interrupted to place adjacent portions of the adhesive side of the tape in facing relationship with respect to one another. The gripping tab is completed by pressing the facing adhesive portions against one another causing the adhesive surfaces to stick together. The tab forming mechanism is preferably located in the tape guide channel immediately upstream of the tape wrapping member.

BRIEF DESCRIPTION OF SEVERAL VIEWS OF THE DRAWINGS

FIG. 9 is an enlarged cross-sectional view taken generally along line 9—9 of FIG. 8;

FIG. 10 is a cross-sectional view taken generally along line 10—10 of FIG. 9;

DETAILED DESCRIPTION OF THE PREFERRED EMBODIMENT

Figure 1:
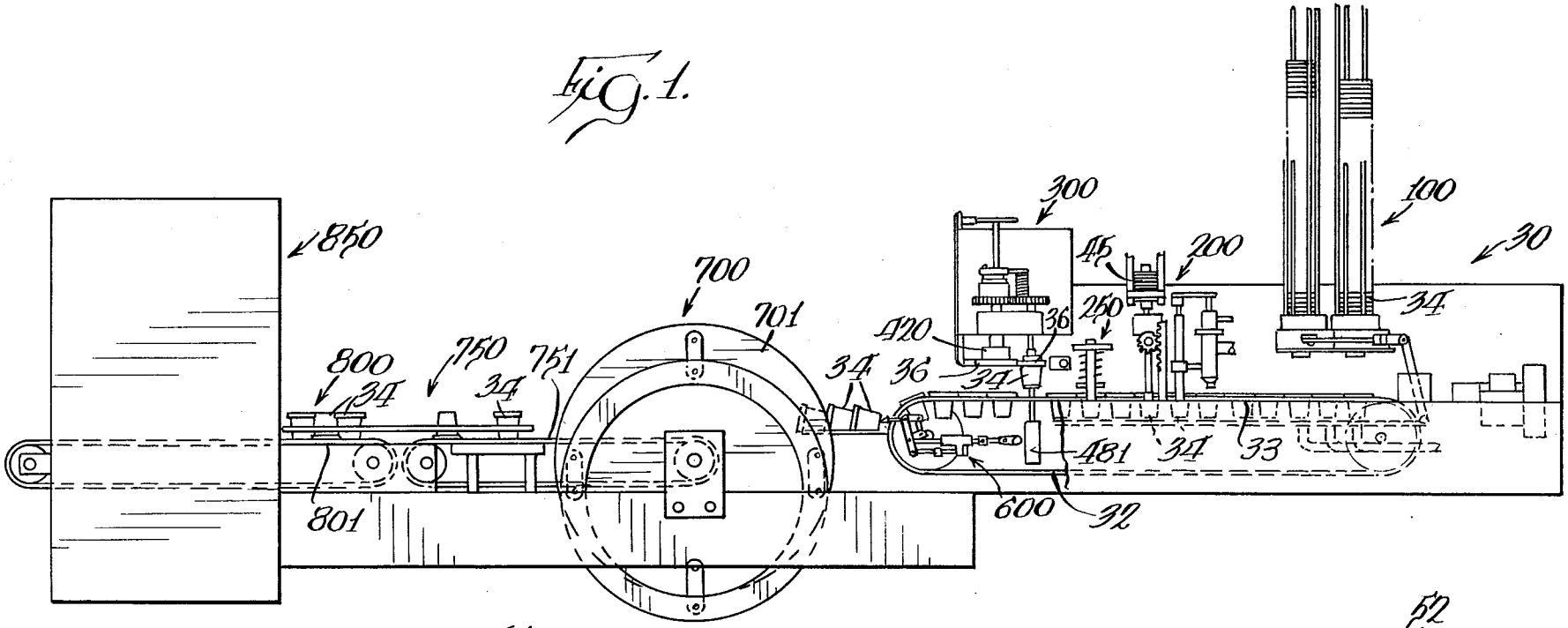
FIG. 1 is a side elevational view illustrating overall packaging apparatus incorporating the present invention.

While this invention is susceptible of embodiment in many different forms, there is shown in the drawings and will herein be described in detail, a preferred embodiment of the invention with the understanding that the present disclosure is to be considered as an exemplification of the principles of the invention, and is not intended to limit the invention to the embodiment illustrated. The scope of the invention is pointed out in the appended claims.

General Packaging System

The secondary closure apparatus according to the present invention is illustrated in use with an automated filling and sealing machine for nestable containers. Such an apparatus is illustrated in FIG. 1. The overall packaging apparatus is indicated at 30 in FIG. 1 and includes a common drive mechanism (not shown) for driving all the moving parts of the apparatus. The apparatus 30 includes an intermittently driven endless conveyor means 32 that defines a path for a plurality of containers 34 which are supplied to the conveyor at a dispensing station 100. The containers 34 are inserted into apertures 33 in the conveyor means 32 and then are moved past a filling and cover applying station 200, where flowable product is placed into the containers and lids 45 are applied to the containers. The lids are subsequently pressfit onto the containers at a sealing station 250 downstream of the filling and cover applying station. The containers 34 are then moved to a secondary closure station 300 where they are lifted from the conveyor 32 into alignment with a wrapping head 420 which applies a secondary closure 35 comprising a band of heat-shrinkable thermoplastic tape 36 to the container 34, as will be discussed in greater detail below.

After the secondary closure 35 has been applied, the container 34 is inserted back into the apertured conveyor 32 and moved to a discharge station 600, where the containers 34 are transferred to an inverting mechanism 700 comprising two pairs of spaced apart, rotating plate-like hubs 701 positioned transversely to the path of the rows of containers. Transfer fingers, (not shown) move the containers 34 from inverting mechanism 700 to a transfer conveyor 750 having two endless converging belts 751, which receive the alternately inverted containers from the inverting mechanism 700, and carry the containers to the collating apparatus 800 where the containers are positioned into nested groups due to the alternate inversion of adjacent containers. The collating apparatus 800 includes a continuously moving belt 801 which carries the alternately inverted containers 34 to a fixed stop (not shown) where they are grouped for final transfer and packaging to a container transfer conveyor 850. It is noted that the present invention has applicability with other types of filling machines, but has particular utility where alternate containers are inverted in packaging as described above.

The apparatus depicted in FIG. 1, except for the tamper-proof closure station 300, comprises known automatic filling machine apparatus. Specifically, the conveyor means 32, and the filling and cover applying station 200 may be of the type shown and described in U.S. Pat. No. 3,487,622 to Mueller, assigned to the same assignee as the present invention, and incorporated herein by reference. The dispensing station 100 may be of the type shown and described in U.S. Pat. No.

3,838,550 to Mueller, assigned to the same assignee as the present invention, and also incorporated herein by reference. The discharge station 600, inverting mechanism 700, transfer conveyor 750, collating apparatus 800 and transfer conveyor 850 may be of the type shown and described in copending continuation-in-part Mueller et al. application Ser. No. 547,647, filed Feb. 6, 1975, now abandoned, assigned to the same assignee as the present invention, and also incorporated herein by reference.

The Container

Figure 2:
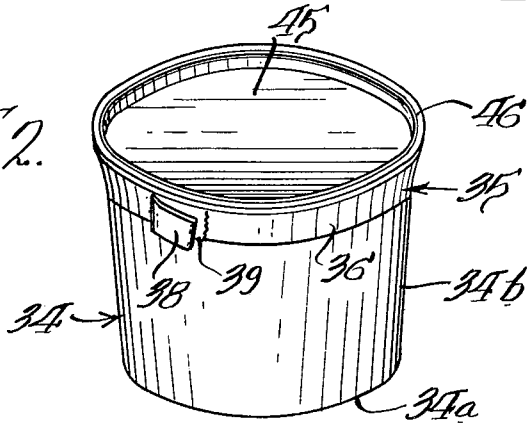
FIG. 2 is an enlarged perspective view of a filled and sealed container having a secondary closure according to the present invention.
Figure 18:
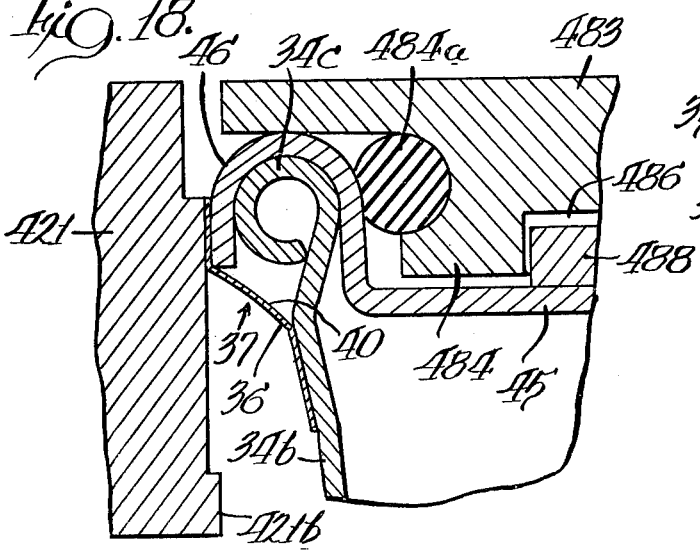
FIG. 18 is an enlarged fragmentary cross-sectional view taken generally along line 18—18 of FIG. 15.
Figure 19:
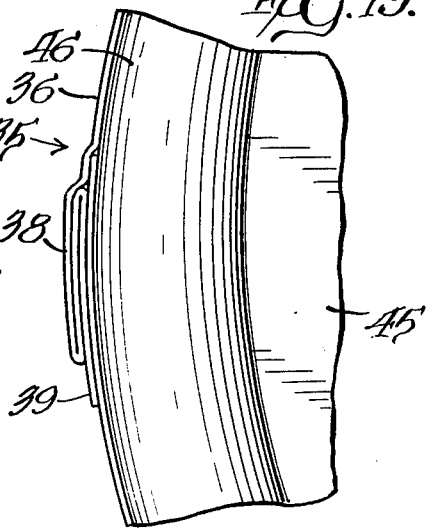
FIG. 19 is an enlarged fragmentary top view illustrating the grip tab portion of the secondary closure according to the present invention.

A nestable container 34 provided with a secondary closure 35 as produced by the method and apparatus of the present invention is shown in FIGS. 2, 18 and 19. The container is generally frusto-conically shaped, having a circular base or bottom 34*a*, a sidewall 34*b* extending upwardly therefrom and defining an open top with a circular rim or bead 34*c* extending outwardly from the upper end of the sidewall. A lid 45 is fitted on the open top of the container 34 to seal the container 34. In position, the lid 45 is recessed from the top of the sidewall 34*b* and has a generally inverted U-shaped periphery, the outer leg of which forms a skirt 46, that snugly fits over the rim 34*c* to seal the container.

The secondary closure 35 consists of a band of heat-shrinkable thermoplastic tape 36 of predetermined length having an adhesive or tacky side and a non-adhesive or non-tacky side. Suitable tape for this purpose may be a vinyl film commercially available under the trademark "Paklon" from the Industrial Tape Division of Minnesota Mining and Manufacturing Company.

The adhesive or tacky side of the tape 36 is applied to the container so that an upper portion of the adhesive side is attached to the skirt 46. The lower portion of the adhesive side of tape 36 is attached to the sidewall 34*b*. The tape is heat-shrunk around the container 34 so that it bridges a seam indicated at 37 (FIG. 18) formed between the sidewall 34*b* and the skirt 46 of lid 45. A gripping tab 38, formed of juxtaposed folded integral portions of tape 36 is provided in the tape a short distance from an outer overlapping end 39 thereof for easy removal of the tape 36 by a user. The adhesive (indicated at 40 in FIG. 18) on one side of the tape 36 is used for initially applying the tape to the container before it is heat-shrunk, as will be discussed in greater detail later. The adhesive on tape 36, however, also serves to secure overlapping end 39 to the underlying tape 36, thus preventing the gripping tab 38 from being accidently pulled or snagged.

It is noted that container 34 and lid 45 may be formed of any suitable material, well understood to those skilled in the art, and the sidewall may be ribbed, smooth, plain or decorated. It should also be noted that the present invention is not limited to any specific container shape, so long as the container is susceptible of receiving the band of thermoplastic heat-shrinkable tape 36 according to the method and apparatus of the present invention.

The Package

Figure 3:
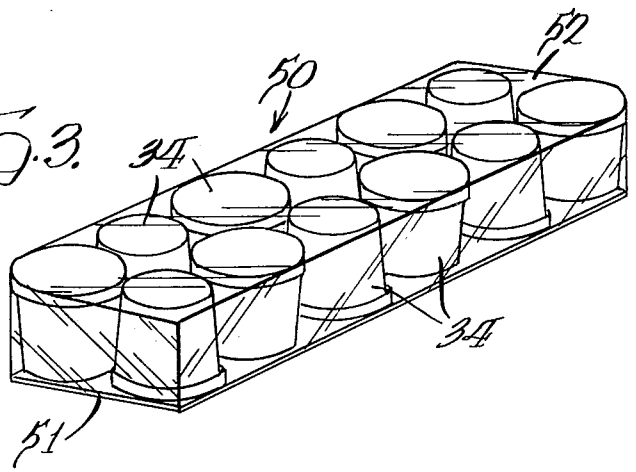
FIG. 3 is a perspective view on a reduced scale of a package of filled containers produced by the apparatus of FIG. 1.

Turning now to FIG. 3, a package 50 containing a group of containers 34 produced by the apparatus of FIG. 1 is shown. The method and apparatus for producing the package 50 is fully discussed in above-mentioned copending Mueller et al. application Ser. No. 547,647, the disclosure of which is incorporated herein by reference. Briefly, package 50 as shown consists of one dozen containers 34 lying in two rows of six containers each. Alternate containers in each row are inverted so that adjacent containers in each row nest top to bottom with adjacent containers in the row. The container inversion of each row is alternated so that the containers in one row nest, top to bottom, with adjacent containers in the other row. It will be appreciated, of course, that the other container configurations having greater number of rows and/or different containers in each row may also be formed with the method and apparatus disclosed in the aforesaid Mueller et al. application.

The containers 34 are preferably but not necessarily supported on a thin, flat, generally rectangularly shaped support member 51 formed from a suitable material, such as cardboard, polystyrene or the like. The entire assembly of containers and support member is enveloped in a sheet 52 of heat-shrunken thermoplastic material which maintains the containers in their nested position upon support member 51.

Tape Feed

Figure 4:
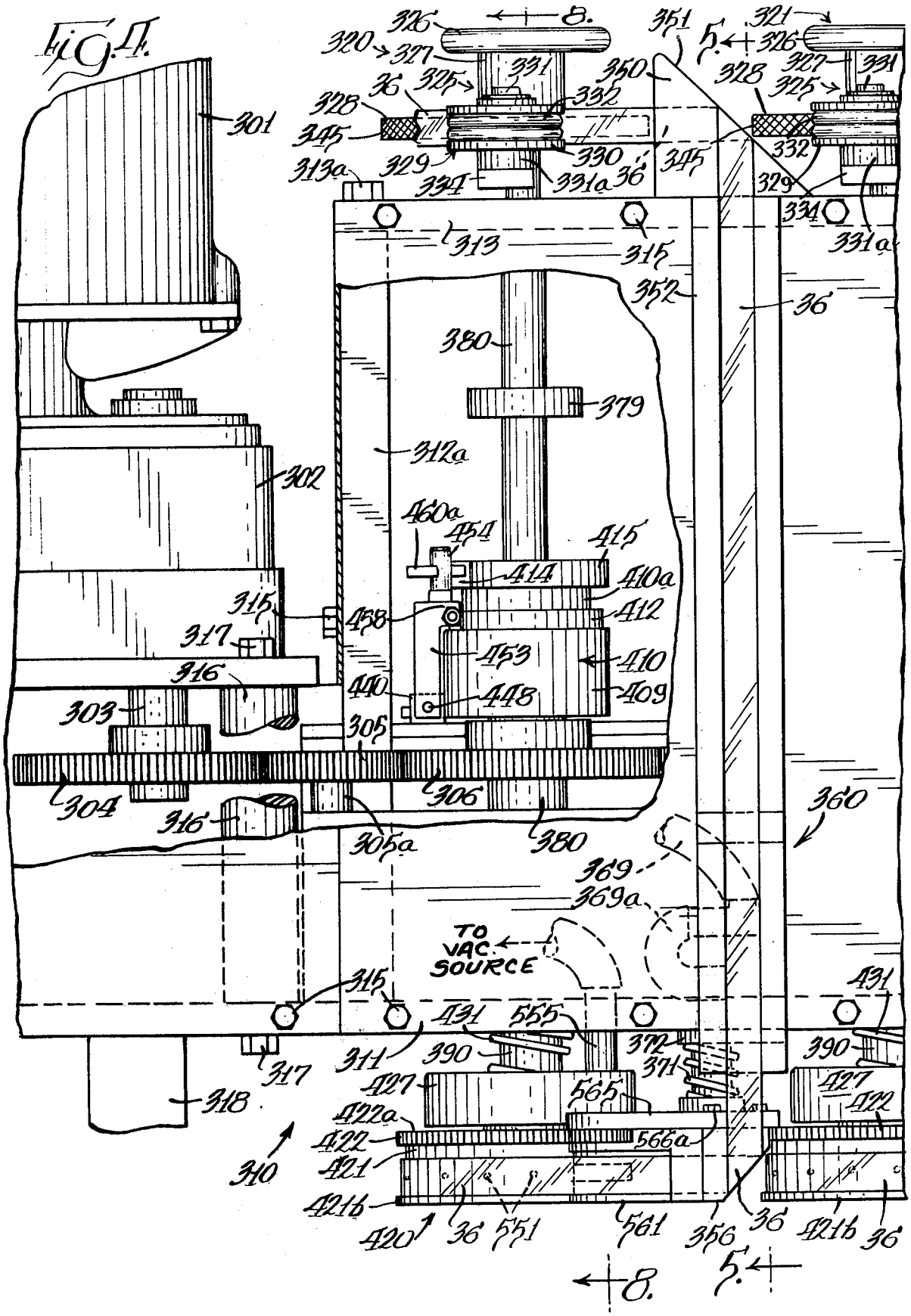
FIG. 4 is an enlarged side elevational view illustrating the secondary closure station of the apparatus of FIG. 1.

Referring to FIG. 4, secondary closure station 300 includes a housing 310 adapted for mounting on existing automatic packaging apparatus, such as shown in FIG. 1, by a plurality of supports 318 secured by fasteners (not shown). Housing 310 consists of a base plate 311, a back plate 312 (FIG. 8) and a number of posts 312*a* projecting upwardly from the base plate 311. A top plate 313 is supported by back plate 312 and posts 312*a*, and is connected thereto by suitable fasteners 313*a*. The housing 310 is preferably rectangular in shape and completely enclosed by side panels 314 secured to the base and top plates 311 and 313 by suitable fasteners 315.

Unlike the other stations making up the overall packaging apparatus 30 (FIG. 1), the secondary closure station 300 is driven by a separate drive mechanism. As best seen in FIG. 4, the drive mechanism consists of an electric motor 301 of standard design having an output shaft (not shown) connected to a gear reduction mechanism 302. Motor 301 and gear reduction mechanism 302 are mounted on base plate 311 by a plurality of posts 316 and fasteners 317. Gear reduction mechanism 302 has an output shaft 303 which rotates, when driven by motor 301, a drive gear 304 connected thereto. Drive gear 304 is meshed with an idler gear 305 mounted on housing 310 for free rotation by a shaft 305*a*. Idler gear 305 in turn is meshed with a spindle gear 306 mounted on a tubular sleeve portion 411 of a clutch 410. Gear 306 is also meshed with a gear 401 (FIG. 8) which drives a container driving assembly 480. During operation, gears 304, 305, 306 and 401 are constantly revolving.

Commenserate with the overall apparatus 30 of FIG. 1, the secondary closure station 300 is set up to wrap two containers simultaneously moving side by side along conveyor means 32. In order to do this, two identical metering assemblies 320 and 321 (FIG. 4) are provided to handle the two containers. It is noted that the number of metering assemblies would correspond to the number of containers being simultaneously fed. For purposes of simplification, discussion of the secondary closure station will be limited to a single metering assembly, it being understood that other metering assemblies would operate identically. Component parts of the two metering assemblies 320 and 321 where shown, are numbered identically.

Figure 5:
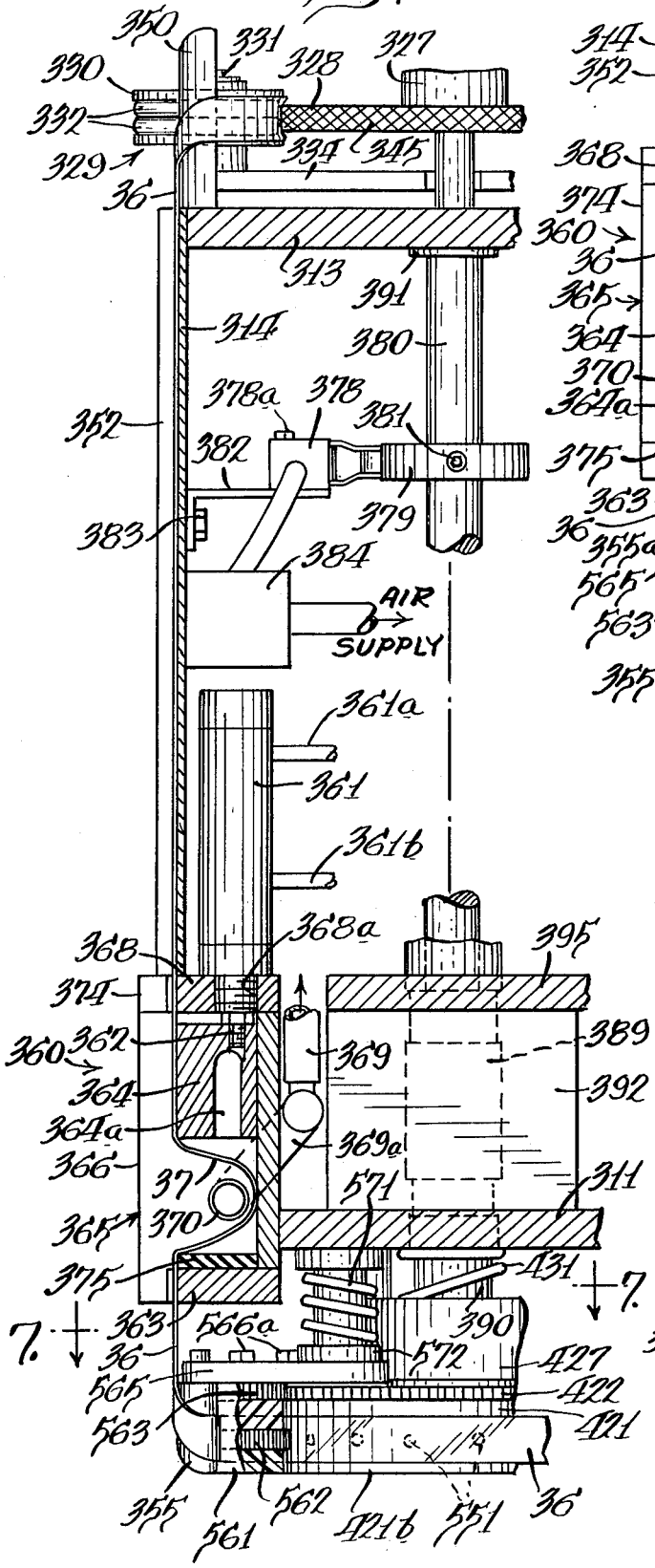
FIG. 5 is a fragmentary cross-sectional view taken generally along line 5—5 of FIG. 4, with certain portions broken away for clarity of illustration.
Figures 8, 8A:
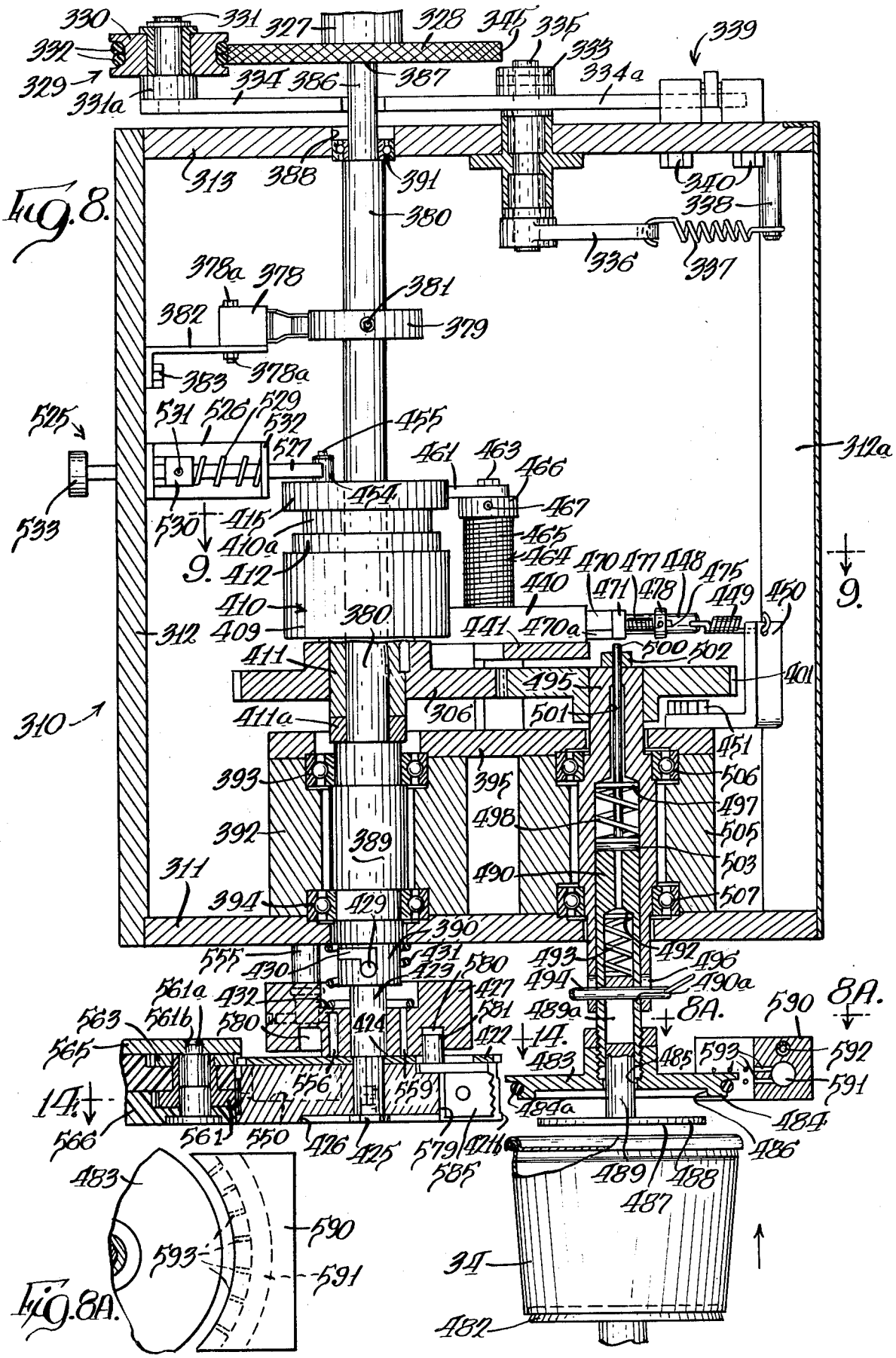
FIG. 8 is a cross-sectional view taken generally along line 8—8 of FIG. 4.
FIG. 8A is a fragmentary cross-sectional view taken generally along line 8A—8A of FIG. 8.

Tape 36 from individual tape supplies (not shown) is drawn to each metering assembly by a top feed mechanism 325. Referring to FIGS. 4, 5 and 8, the top feed assembly includes a tape feed wheel 327, tape guide roll 329 and tape block 350. Tape feed wheel 327 is mounted atop a spindle 380 and consists of a circular disc 328 having a handle 326 protruding upwardly therefrom for hand manipulation of the wrapping assembly in the event of such a necessity.

Positioned adjacent disc 328 is the tape guide roll 329 consisting of a roller 330 mounted on a shaft 331 for free rotation. The peripheral edge of roller 330 is recessed to hold a pair of rubber O-rings 332. As best seen in FIG. 8, tape guide roll 329 is mounted on the end of a lever 334 by an enlarged portion 331*a* of shaft 331. The lever 334 is pivotally connected to a swivel block 333. Swivel block 333, which is mounted on plate 313 so as to extend therethrough, includes a shaft 335 having one end keyed to the lever 334 and another end connected to a spring bracket 336. A spring 337, anchored to a post 338 fixedly attached to top plate 313, is attached to spring bracket 336 and applies pressure which tends to pivot lever 334 about swivel block 333 to maintain tape guide roll 329 in pressure engagement with the edge of tape feed wheel 327. A manually operated latch mechanism 339, secured to the top plate 313 by fasteners 340, is provided for holding an arm 334*a* of lever 334 so that the tape guide roll 329 can be maintained separated from the tape feed wheel 327 during manual insertion and removal of tape 36 from the top feed assembly 325. Tape 36 is fed through the top feed assembly 325 so that the adhesive side contacts the peripheral edge of tape feed wheel 327 and the non-adhesive side contacts O-rings 332. The peripheral edge of tape feed wheel 327 is knurled as shown at 345 so that the adhesive surface of tape 36 makes only minimal area contact with the edge of the tape wheel 327.

The total length of tape 36 applied to each container 34, including the amount of tape consumed in gripping tab 38, is measured by the top feed assembly. This is achieved by selecting the diameter of disc 328 such that its circumference is equal to the total length of tape desired. As will be described later, spindle 380 is intermittently rotated one revolution at a time by the action of clutch 410 which operates to connect shank portion 411 to spindle 380, causing disc 328 to rotate one revolution, thereby issuing a length of tape 36 equal to the circumference of the knurled peripheral edge 345 of disc 328 through the top feed assembly 325. Tape 36 from the tape supply proceeds horizontally through the top feed assembly 325 and is advanced to a tape guide block 350 where it passes over an inclined surface 351 and is oriented in a vertical direction for transfer to a gripping tab forming assembly 360.

Gripping Tab Forming Assembly

Tape 36 from the top feed assembly 325 travels vertically downward along a tape guide 352 such that the adhesive side faces outwardly. Another tape guide block 355, similar to tape guide block 350, reorients tape 36 back into a horizontal direction of travel at the lower end of guide 352 for transfer onto wrapping head 420 as will be discussed later. As is evident from FIG. 4, guide 352 has a width dimension only slightly in excess of the width of the tape so as to closely confine the tape therewithin. Located along tape guide path 352 between the two tape guide blocks 350 and 355 is a gripping tab forming mechanism 360. The forming mechanism is spaced from the wrapping head 420 such that the tab 38 will be located near the outer overlapping end 39 of tape 36 when positioned on containers 34 after being severed from the tape supply.

As best seen in FIG. 5, the gripping tab forming mechanism 360 consists of a vacuum chamber 365 attached to base plate 311 and side panel 314 by suitable means, not shown. Chamber 365 is defined, in part, by a pair of parallel plates 374 that are spaced from one another by a distance corresponding to the width of guide path 352. The vacuum chamber 365 is closed except for one surface 366 thereof which opens to the atmosphere. However, the side edges of the tape are positioned sufficiently closely to the sides of the chamber, so that the tape, in effect, provides a moving wall substantially closing the chamber. An air cylinder 361, having a reciprocal rod 362, is threadably mounted in an aperture 368*a* in an upper end wall 368 of vacuum chamber 365 so that the reciprocal rod 362 extends through aperture 368*a* and into the vacuum chamber 365. Rod 362 is threadably connected to a plunger 364, mounted for vertical sliding movement inside vacuum chamber 365. A tube 369 communicates with a source of suction (not shown), and a pipe 369*a* (FIG. 4) is connected between tube 369 and one side of vacuum chamber 365 opening at port 370 for applying suction within the chamber. The suction force applied to the vacuum chamber 365 is sufficient to cause the portion of tape 36 overlying the open surface 366 to be sucked into the chamber, when the tape is not moving such that it takes on a U-shaped configuration 37 generally transverse to the tape, with the adhesive surfaces of the tape facing one another, as shown in FIG. 5. However, the suction force of the vacuum is not strong enough to impede the movement of tape 36 over the vacuum chamber 365. Alternatively, suitable means may be incorporated in the vacuum circuit to interrupt the suction during periods when tape 36 is moving. With the tape 36 in the position shown in FIG. 5, subsequent downward movement of rod 362 advances plunger 364 to the opposite end of vacuum chamber 365 (see FIG. 6). The U-shaped configuration 37 of tape 36 inside the chamber is pressed between the end of piston 364 and a resilient pad 375, for example, made of rubber, attached to the lower end surface 363 of vacuum chamber 365 to cushion the impact of the plunger. In addition, a slot 364*a* is provided in one side of piston 364 in alignment with the port 370 to insure that the suction force will be present in the vacuum chamber until piston 364 nears the end of its stroke. Once pressed together, the adhesive surfaces of tape 36 cause the U-shaped configuration 37 to stick together in the form of a gripping tab 38 projecting outwardly from the non-adhesive surface of tape 36.

The operation of the gripping tab forming mechanism 360 is controlled by an air switch 378 attached to a bracket 382 by a fastener 378*a*. The bracket 382, in turn, is attached to sidewall 314 by a fastener 383. The switch 378 is triggered by a cam 379, which is adjustably mounted on spindle 380 by fastener means 381, in alignment with the switch 378. The timing of the gripping tab forming mechanism 360 is inversely synchronized with the intermittent rotation of shaft 380, so that it operates only during dwell periods in the rotation. Each time shaft 380 makes one revolution and comes to a stop, cam 379 triggers switch 378 which in turn activates a pressure sensitive valve 384 which applies air from an air source (not shown) to air cylinder 361 through line 361*a*. As stated above, the vacuum at port 370 causes the U-shaped configuration 37 in tape 36 to be formed. Once the plunger 364 has been advanced and the tab formed, pressure is applied to air cylinder 361 from another tube **361*b* to retract the rod 362 and plunger 364. Tape 36 is then free to advance during the next revolution of spindle 380**. The vacuum circuitry used in the present invention is well known to those skilled in the art and commercially available. Therefore, a further detailed description is not considered necessary.

Tape Drive Mechanism

As is mentioned briefly above, spindle 380 controls the tape metering means 320, tab forming means 360 and tape wrapping means 420. As can be best seen in FIGS. 4 and 8, spindle 380 consists of an elongated shaft mounted vertically in housing 310. An upper end portion 386 of spindle 380 is reduced in diameter and extends through an aperture 388 in top plate 313. Spindle 380 is rotatably mounted in top plate 313 by means of a bearing 391. The tape feed wheel 327 is secured to the upper end of spindle 380 as indicated at 387. The spindle 380 extends downwardly through the clutch 410 and then is enlarged (indicated at 389) where it passes through an annular bearing housing 392 mounted on base plate 311. The bearing housing 392 is provided with vertically displaced bearings 393 and 394 for rotatably mounting the spindle 380 to the base plate 311. Bearings 393 and 394 are secured in bearing housing 392 by a top plate 395 and the base plate 311, respectively. The extreme lower end 390 of spindle 380 extends through an aperture **311*a* in base plate 311, and the lower end 390 is detachably connected to wrapping head 420** as will be discussed later.

The clutch 410 is a standard single revolution clutch mechanism, for example, of the type manufactured by the Hilliard Corp., Elmira, N.Y. Briefly, clutch 410 includes a generally cylindrically shaped clutch body 409 having a sleeve portion 411 extending axially downwardly therefrom. Sleeve 411 is rotatably mounted on spindle 380, and is keyed to gear 306, so that the sleeve and clutch body are constantly rotated. Sleeve 411 rides on a bearing **411*a* (FIG. 8) that rests on enlarged portion 389 of spindle 380. A hub (not shown) within clutch body 409 is fixed to spindle 380, and carries clutch rollers in a pivotally mounted cage member, with the clutch rollers being normally spaced from spindle 380 when the clutch is disengaged. When the clutch is engaged, the cage within clutch body 409 is pivoted relative to the spindle 380 to place the rollers in driving engagement with the spindle, and cause it to revolve 360°. This is controlled by a cam 412 pivotally mounted on the hub of the clutch above the clutch body 409. As will be discussed in greater detail later, when the clutch is disengaged, a stop on the cam 412 is engaged by a trip lever, causing the cam 412 to pivot on the clutch hub and disengage the clutch rollers from spindle 380. When the trip lever is released from engagement with the stop on cam 412, a spring (not shown) pivots the cam 412 to the driving position to connect the gear 306 to spindle 380 causing the spindle and the clutch to rotate 360° until the stop on cam 412 is re-engaged by the trip lever thereby disengaging the clutch. As also will be discussed in greater detail later, a second cam 415 is mounted on clutch 410 and has a stop surface engageable by a second lever. The cam 415 functions as a secondary stop to ensure that the spindle 380 is rotated exactly one complete revolution by the clutch 410** and then is disengaged.

Figure 11:
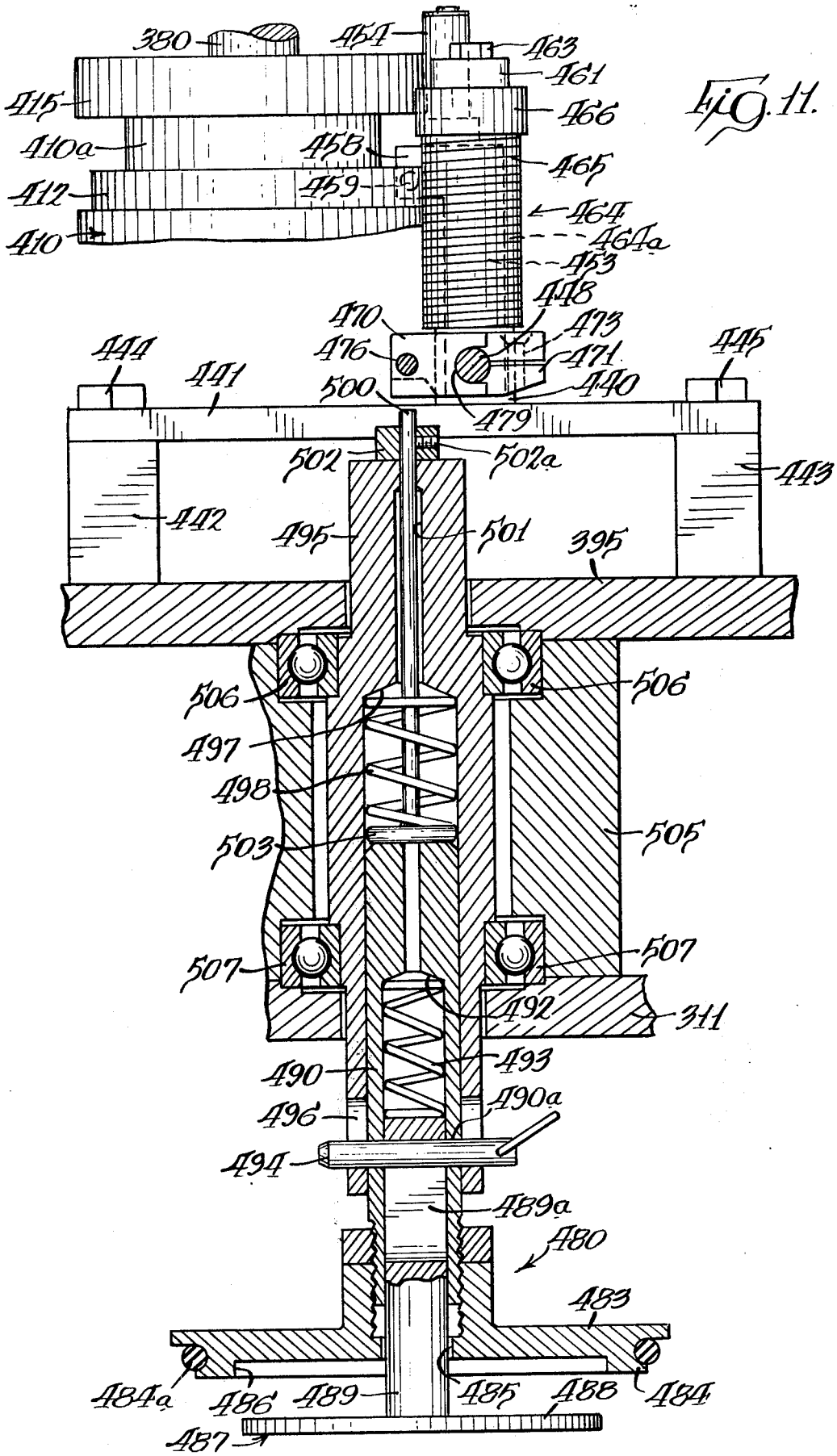
FIG. 11 is a cross-sectional view taken generally along line 11—11 of FIG. 9.

The clutch trip mechanism, which is shown in FIGS. 8–13, is associated with the container driving assembly 480, best seen in FIGS. 8 and 11. Containers 34, intermittently moved along conveyor means 32 (FIG. 1), are aligned directly under the container driving assembly 480 at the secondary closure station, where they are raised by a cam operated arm 481, which may operate similar to the one disclosed in U.S. Pat. No. 3,487,622. A freely rotatable platform 482 is positioned at the upper end of arm 481 for supporting a container 34. The container 34 is raised by arm 481 into engagement with a container spinner 483 having an annular portion 484 adapted to fit within the recessed interior of lid 45. A rubber O-ring **484*a* is positioned on the peripheral edge of annular portion 484 to ensure good contact between the periphery of lid 45 and the spinner 483. An axial bore 485 is provided in spinner 483 together with a recessed portion 486 for receiving a container stripping plunger 487. The plunger 487 consists of a base plate 488 and a shaft 489 which are adapted to fit within the bore 485 and recess 486 as the container 34 engages spinner 483**.

Threadably fitted within bore 485 of spinner 483 is a hollow tubular shaft 490 in which shaft 489 of plunger 487 is received. The interior diameter of the shaft 490 is sharply reduced at one end as shown at 492. A spring 493 is positioned within shaft 490 such that one end thereof rests against the reduced diameter end 492. The other end of spring 493 bears against the upper end of shaft 489 to bias plunger 487 outwardly of spinner 483 for stripping lid 45 off the spinner during downward movement of container 34 away from the container driving assembly 480 after the secondary closure has been completed. A detachable pin 494 is inserted through diametrically aligned openings **490*a* in shaft 490 and slot 489*a* in shaft 489 to retain plunger 487 in the cup spinner 483. Slot 489*a* allows for axial movement of shaft 489 within shaft 490 under the influence of spring 493**.

Shaft 490 fits within a larger diameter hollow drive shaft 495 and is retained therein by pin 494 which passes through the shaft 490 and diametrically aligned slotted apertures 496 in drive shaft 495. Similar to the arrangement inside shaft 490, drive shaft 495 is also sharply reduced in diameter as shown at 497. A spring 498 is positioned within drive shaft 495 such that one end bears against the reduced diameter portion 497. A clutch trip rod 500 extends axially through spring 498 upwardly through a reduced diameter segment 501 of drive shaft 495, and out the top of the drive shaft 495. Trip rod 500 has a diametrically enlarged circular base 503 that is biased against the top of shaft 490 by spring 498. The rod 500 is retained in a fixed position relative to shaft 495 by a collar 502 attached to rod 500 by fastener **502*a* (FIG. 11), and which is biased against the upper end of shaft 495. The clutch trip rod 500 is movable vertically upwardly within drive shaft 495 as the result of upward vertical movement of the container spinner 483**.

Drive shaft 495 is mounted for axial rotation in an annular bearing housing 505 positioned on base plate 311. The bearing housing 505 is provided with vertically displaced bearings 506 and 507 which are secured therein by base plate 311 and top plate 395. Spinner gear 401 (FIG. 8) is fixedly attached to the upper portion of drive shaft 495. As discussed above, spinner gear 401 is driven by motor 301, which causes drive shaft 495, shaft 490 and spinner 483 to rotate.

During operation, container spinner 483 is constantly revolving as container 34 is raised into engagement therewith. As the container 34 comes into contact with container spinner 483, plate 488 of plunger 487 engages the lid 45 and is forced upwardly into recess 486. Annular portion 484 fits within the recessed portion of lid 45 such that O-ring 484*a* engages the inner surface of the periphery 46 of lid 45. As soon as container 34 is sufficiently engaged by spinner 483 under the bias of spring 498, it will begin to rotate on freely rotatable platform 482. The upward travel produced by arm 481 also causes the container 34 to move the spinner 483 slightly upward, raising shaft 490 and trip rod 500 within the limits of movement of pin 494 in slots 496, thereby activating the clutch trip mechanism.

Before discussing the clutch trip mechanism in detail, it is noted that when the container 34 is in position on cup spinner 483, the rim portion 46 of the container 34 is in side-by-side tangential relationship with wrapping head 420 (see FIG. 18). As will be discussed later, the wrapping head 420 rotates one revolution when the clutch trip mechanism is activated, and transfers tape 36, which is detachably held thereon by vacuum, onto the spinning container 34. The upper portion of container 34 is aligned with the wrapping head 420 so that the tape 36, when wrapped around the container, will bridge the seam formed between the periphery 46 of lid 45 and sidewall 34*b* of container 34. The tape 36 is initially retained on the outer surface of inverted U-shaped periphery 46 of lid 45 by the adhesive 40 (FIG. 18) on the tape.

As best seen in FIGS. 8 and 8*a*, positioned adjacent the container spinner 483 is an arcuate heater block 590 having a heating duct 591 therein. The duct 591 has a plurality of ports 593 extending radially inwardly towards the upper portion of a container 34 positioned on the spinner 483. An arcuate heating element 592 is disposed in heat transfer relationship with block 590 directly above duct 591 for heating block 590 and the air passing through duct 591. Heating element 592 may be an electrical resistance heating element connected to a suitable source of electricity, not shown. Duct 591 is connected to a source (not shown) of air under pressure which is forced through duct 591 and out the ports 593 towards the container 34, thereby heat-shrinking the tape 36 onto the container sidewall 34*b* immediately adjacent the outer surface of inverted U-shaped periphery 46 as the container is rotated relative to the heater block.

Turning to FIGS. 9–13, the basic components of the clutch trip mechanism can be seem. A horizontally disposed trip guide 440 is fixedly attached to a support plate 441 that is supported by upright supporting posts 442 and 443 mounted on top plate 395 and secured to plate 441 by fasteners 444, 445. A trip shaft 448 is supported for axial and rotary movement within guide 440, and a trip spring 449 is attached to one end of shaft 448 to bias the shaft to the right, as viewed in FIG. 10. The opposite end of spring 449 is anchored to L-shaped bracket 450 (FIG. 8), that is secured to top plate 395 by fastener 451. The opposite end of trip shaft 448 is fixedly attached to a trip arm 453, which extends upwardly from guide 440. As is clear from FIGS. 9, 11 and 12, the axis of shaft 448 is offset from the vertical axis of rod 500. The upper end of trip arm 453, as viewed in FIG. 10, has a horizontal extension 453*a* that is provided with an upright roller 454 mounted on a shaft 455 which is secured to extension 453*a*. Projecting generally perpendicular to the extent of arm 453 is a first cam follower 458 having an adjusting bolt 459 extending therethrough. Cam 412 is pivotally mounted on the hub of clutch 410 is indicated at 412*a*, and when viewed from the top, (FIG. 9), cam 412 defines a spiral path having an outwardly extending clutch stop surface 416. Bolt 459 of cam follower 458 rides along the surface of cam 412 when clutch 410 is engaged, and bears against stop 416 when the clutch is disengaged. Arm 453 functions as a trip lever for actuating clutch 410, as will hereinafter appear.

A second horizontally disposed lever 461 is fastened at 463 atop a torsion spring post assembly 464 in spaced parallel relation above extension 453*a*. Assembly 464 includes a pivotally mounted vertical post 464*a*, a torsion spring 465, and a spring collar 466 fastened to the post 464 at 467. Spring 465 is pretensioned to apply pressure to an arm 461 causing it to rotate towards clutch 410 (FIG. 9). A second cam 415 is mounted on spindle 380 above cam 412 and is spaced therefrom by bushing 410*a*. As seen in FIG. 9, cam 415 defines a generally circular cam surface and is provided with a detent 413 therein having a clutch stop surface 414. Lever 461 includes a cam follower 460 facing cam 415, and having a stop surface 460*a* thereon. Stop arm 461 is also provided with a contact surface 462 outwardly of follower 460 for engagement with roller 454.

The clutch trip mechanism is actuated by clutch trip rod 500. As containers 34 are raised into engagement with container driving assembly 480, container spinner 483 is raised causing shaft 490 and rod 500 to rise. Referring to FIGS. 9–12, positioned adjacent the upper end of rod 500 are first and second trip blocks 470 and 471 mounted on shaft 448. Block 471 is clampingly secured to the shaft 448 by fastener 473. Block 470 is secured to block 471 by means of a post 475 extending through an aperture 476 in block 470 and threadably secured in block 471. A spring 477 retained on post 475 by collar 478 resiliently urges block 470 into engagement with block 471. An arcuate groove 479 in block 471 (FIG. 12) embraces shaft 448 to support block 471 for pivotal movement of shaft 448.

Figure 12:
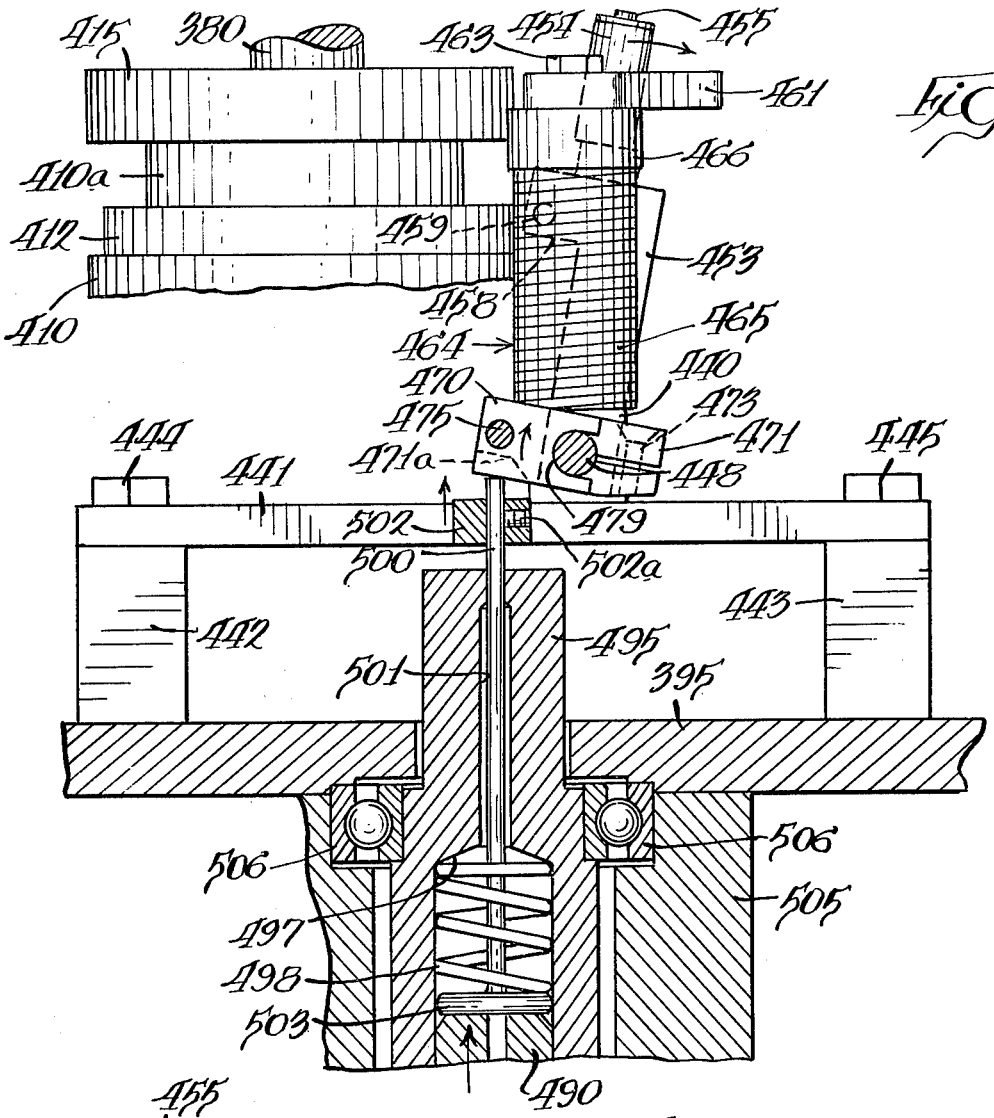
FIG. 12 is a fragmentary cross-sectional view like FIG. 11 but illustrating the clutch trip mechanism when it is released.

In operation, as trip rod 500, which is initially aligned beneath block 470, moves upwardly, it engages trip block 470 and pivots it causing the trip shaft 448 to rotate about its longitudinal axis from the position of FIG. 11 to the position of FIG. 12. This causes trip arm 453 to pivot with shaft 448 and cam follower 458 out of engagement with cam stop 416 of cam 412. Simultaneously therewith, roller 454 is moved causing arm 461 to pivot and move cam follower 460 out of engagement with the cam stop 414 of cam 415. Once the cam followers have moved out of engagement with their respective stops, trip shaft 448 is freed and pulled by spring 449 a short distance axially through trip guide 440 until trip arm 453 abuts against the trip guide 440 (see FIG. 13). At the same time, cam 412 is pivoted about mounting 412*a*, for example, by spring means (not shown) and operates to engage the clutch 410 to spindle 380. This causes the spindle 380 and cams 412 and 415 to rotate one revolution with the gear 306.

Figure 13:
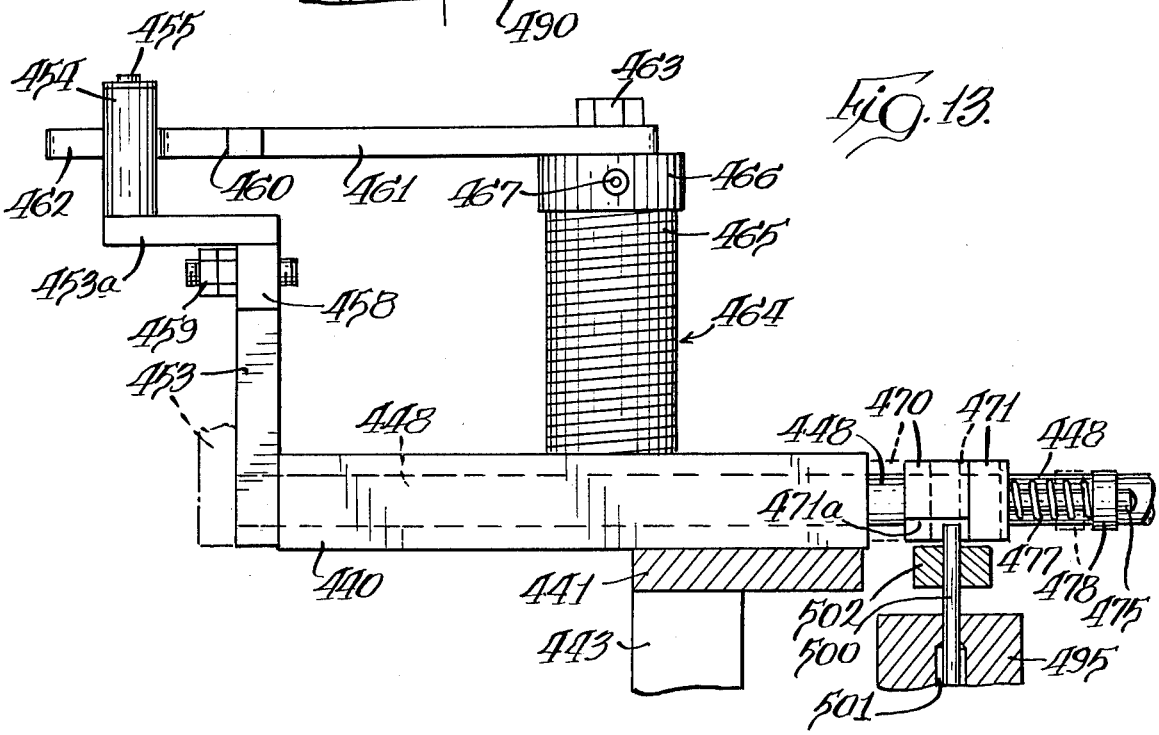
FIG. 13 is a fragmentary cross-sectional view like FIG. 10, with the clutch trip mechanism in a released position.

During the one revolution of clutch 410, first and second cam followers 458 and 460 ride on the surfaces of cams 412 and 415, respectively, because of the pressure applied by torsion spring assembly 464 on roller 454 through arm 461. As follower 458 rides the inwardly spiralling surface of cam 412, it will cause the trip arm 453 and trip shaft 448 to rotate from the position shown in FIG. 12 toward the position of FIG. 11. With the trip shaft 448 axially displaced by spring 449, the trip block 471 is now aligned directly over the upper end of the raised trip rod 500, as seen in FIG. 13. A notch 471*a* is provided in block 471 so that as the shaft 448 rotates from the position of FIG. 12 toward the position of FIG. 11, a clearance is provided for the raised rod 500.

After cams 412 and 415 make one revolution, first and second cam followers 458 and 460 re-engage the cam stops 416 and 414, respectively. Since trip shaft 448 has been axially displaced, cam follower 458 is laterally displaced with respect to cam follower 460 and will be in position to engage clutch stop 416 first. The inertia from the revolving elements causes the trip shaft 448 to move axially along trip guide 440 against the tension exerted by spring 449 when clutch stop 416 makes contact with follower 458, thereby slowing the speed of cam 412. Movement of spindle 380 is brought to a complete stop when cam follower 460 engages clutch stop 414 of cam 415. It has been found that this dual clutch stop arrangement ensures that spindle 380 is disengaged by the clutch 410 and stopped at the same point after each revolution thereof. It also greatly reduces wear and tear on the clutch mechanism.

An additional feature of the present invention lies in a safety mechanism that ensures that the clutch mechanism will be acutated only once while the same container 34 is positioned on the container driving assembly 480. As described above, trip shaft 448 first rotates, and then is axially displaced by spring 449 as clutch 410 is actuated. During the course of one clutch revolution, trip shaft 448 is rotated back to its original position, but because of the axial displacement of the shaft, block 471 overlies trip rod 500 instead of block 470. Notch 471*a* in block 471 allows the block to clear the trip rod 500, which is raised when a container 34 is positioned on the container driving assembly 480. When follower 458 engages the clutch stop 416 and axially moves trip shaft 448 back to its original position, the top of trip rod 500 prevents the trip block 470 from moving with the shaft 448. The rod 500 forces block 470 to remain stationary and to slide along post 475. Once the container 34 is removed from the container driving assembly 480, rod 500 will be lowered, permitting trip block 470 to move along shaft 448 back into position directly overlying rod 500 by the action of return spring 477. The clutch trip mechanism will then be reset for operation.

In addition to the clutch trip mechanism just described, a manual clutch trip mechanism 525 is also provided (see FIG. 8). Manual trip mechanism 525 includes a bracket 526 secured to back plate 312 by means not shown. A trip rod 527 is slidably received in aligned apertures in plate 312 and a flange 532 of bracket 526. A spring 529 is fitted on rod 527 and retained by a collar 530 secured to rod 527 by fastener 531. The inner end of rod 527 is positioned adjacent roller 454 of trip arm 453, and manual pressure on the end 533 of rod 527 causes the end of the rod to engage roller 454 pivoting the trip arm 453 (FIG. 12), causing first and second cam followers 458 and 460 to disengage cams 412 and 415. The clutch mechanism is then released and will make one revolution in the same manner as described above in connection with the clutch trip mechanism. Spring 529 operates to return the rod 527 to a clearance position after the clutch 410 has been activated.

The Wrapping Head

Figure 14:
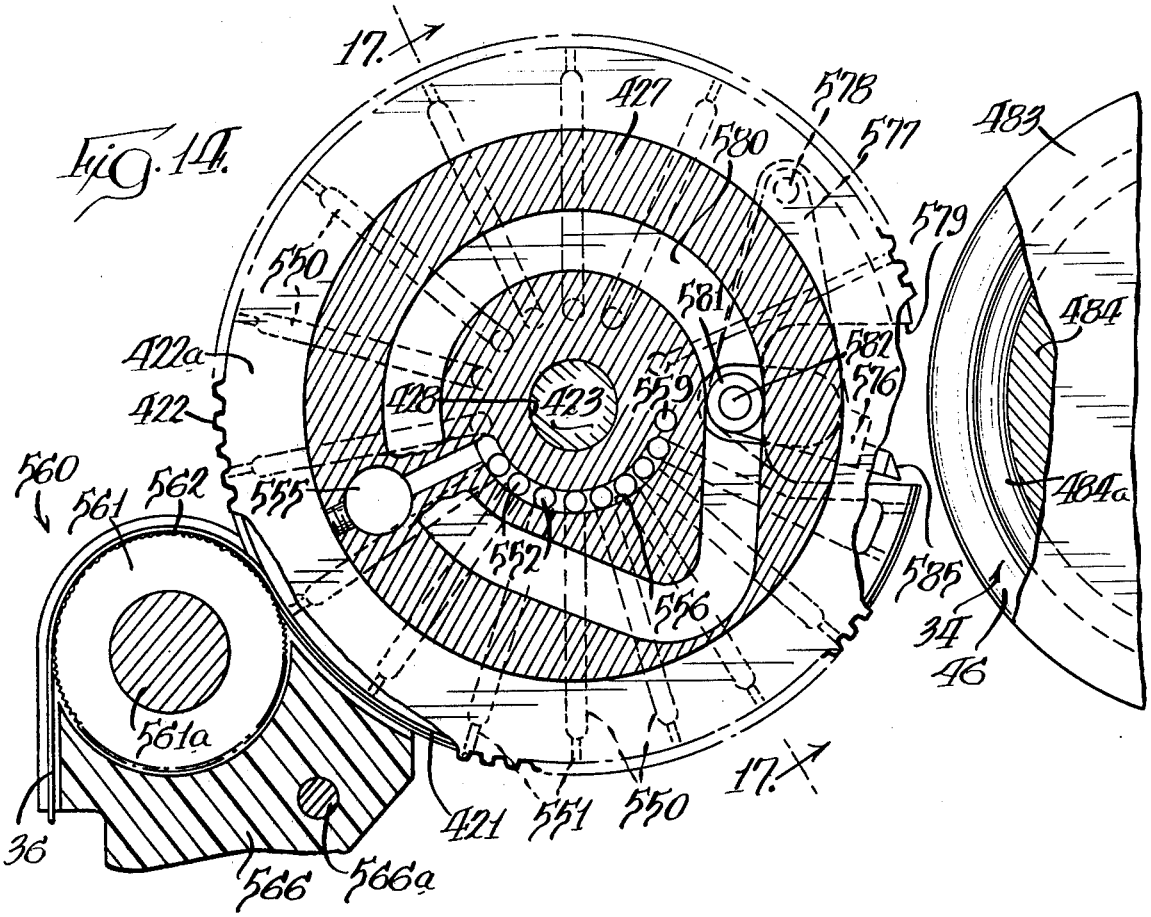
FIG. 14 is an enlarged cross-sectional view taken generally along line 14—14 of FIG. 8.
Figure 15:
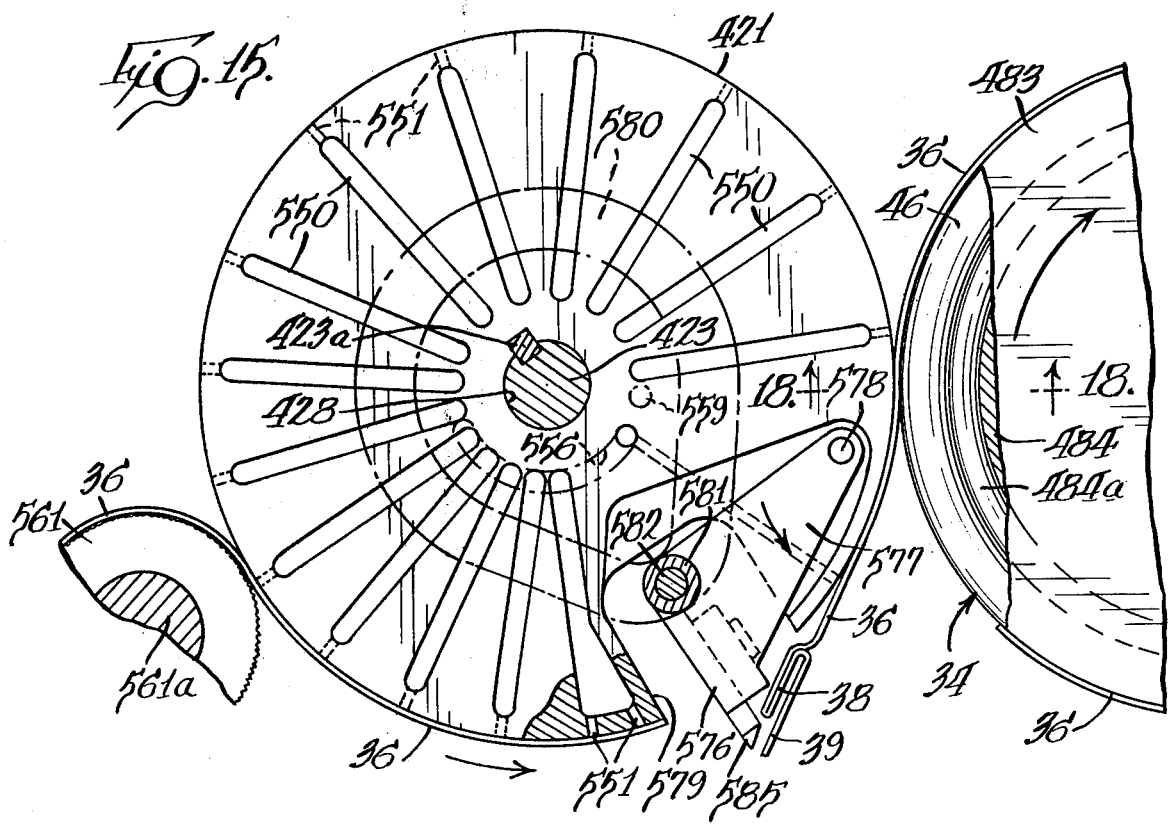
FIG. 15 is a fragmentary view like FIG. 14, but illustrating the wrapping head cutter blade in a fully extended position.

The wrapping head 420 operates to transfer a predetermined length of tape 36 onto a container 34 and to sever the tape 36 from the tape supply. Looking at FIG. 17, wrapping head 420 consists of a cylindrical wrapping member 421 preferably made of a suitable plastic material such as, for example, polypropylene. A disc-like gear 422 of substantially the same diameter as member 421 and having opposing planar surfaces, is positioned on a planar surface 421*a* of member 421, and is held thereagainst by a shaft 423 extending through member 421 and keyed thereto as shown at 423*a* (FIGS. 14, 15). A shoulder 424 on shaft 423 is pressed against gear 422 by a fastener 425 positioned in a recess 426 on the opposite side of member 421 and threadably attached to shaft 423.

Figure 17:
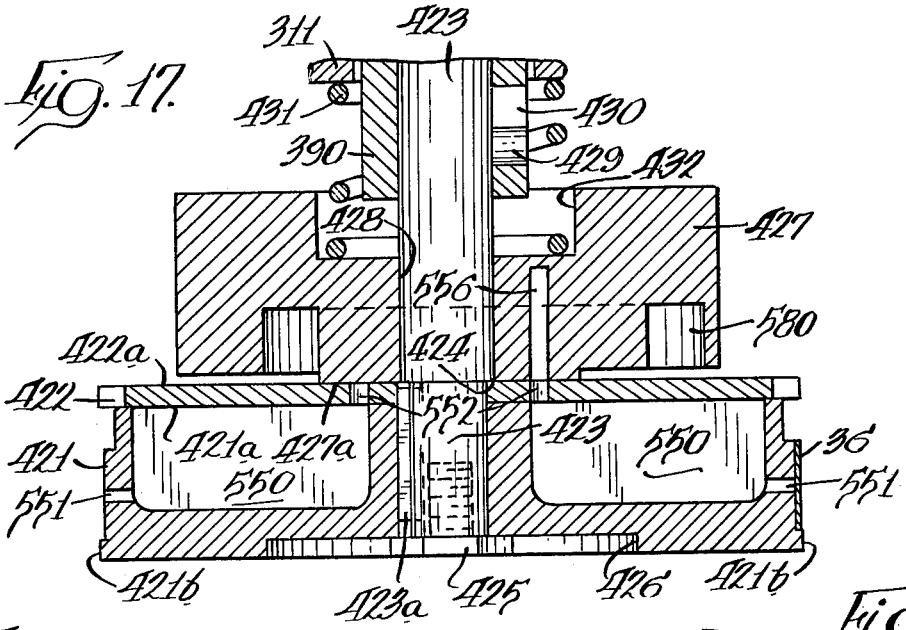
FIG. 17 is a cross-sectional view taken generally along line 17—17 of FIG. 14.

Positioned atop member 421, as viewed in FIG. 17, is a fixed cam block 427 provided with a central clearance aperture 428 therethrough in which shaft 423 extends. The upper end of shaft 423 is connected to the extreme lower hollow end 390 of spindle 380 by a lug 429 which extends outwardly from the shaft 423 into a slot 430 in lower end 390 of spindle 380. A spring 431 extends between the lower surface of base plate 311 and a recess 432 in the upper surface of cam block 427 to maintain lug 429 at the lower end of slot 430 and to press cam block 427 against upper surface 422*a* of gear 422.

Turning to FIGS. 14 and 15, member 421 is provided with a plurality of radially extending slotted passageways 550 that open in small ports 551 on the outer cylindrical surface of member 421. The inner ends of slotted passageways 550 lie on a common radius from the center of member 421. The slotted passageways 550 open to the surface 421*a* of member 421 and are covered by the gear 422. Apertures 552 are provided in gear 422 in alignment with the inner end of slotted passageway 550. A tube 555 carrying vacuum from a vacuum source is supplied to wrapping head 420 through cam block 427 (FIGS. 8 and 14). The vacuum is conducted in cam block 427 to a curved vertical slot 556 (FIG. 14) opening on a planar surface portion 427*a* (FIG. 17) of the cam block 427 in contact with gear 422. The curved slot 556 overlies apertures 552 in gear 422 and is adapted to couple the vacuum supplied by tube 555 simultaneously to a number of adjacent slotted passageways 550 opening on a portion of the cylindrical surface of the member 421.

During operation, the member 421 will be rotated by spindle 380 connected to shaft 423, but the cam block 427 is held stationary by the tube 555 and will ride on the moving surface of gear 422. By this arrangement, individual slotted passageways 550 are sequentially connected to the vacuum source as the apertures 552 in gear 422 move into alignment with the curved slot 556 in cam block 427. In like manner, as the apertures 552 move out of alignment with the slot 556 as member 421 rotates, the vacuum is removed from the individual slotted passageways 550.

According to the present invention, the non-adhesive side of tape 36 is adhered to the portion of the cylindrical surface of member 421 where the ports 551 have vacuum present. A ledge 421*b* is provided on the member 421 to prevent the tape from slipping off the edge of the cylindrical surface. The member 421 is then rotated to transfer the tape 36 onto a container 34. Looking at FIG. 14, vacuum is sequentially disconnected from the moving slotted passageways 550 as apertures 552 pass out of alignment with the curved slot 556 to free the tape 36 from the suction force adhering it to the member 421 for transfer of the tape to the container. An air vent 559 opening through cam block 427 to the atmosphere is positioned adjacent slot 556 to provide a quick vacuum release for the slotted passageways as they pass so that the tape 36 will immediately be freed for transfer to the adjacent rotating container 34.

The diameter of cylindrical member 421 is selected so that its circumference is greater than the circumference of the rim portion of container 34. Thus, one revolution of the member 421 by spindle 380 causes more than one revolution of tape to be wrapped around container 34. This causes the tape 36 to overlap on the container creating the desired outer overlapping end 39. The ratio of gears 306 and 401 is selected so that wrapping member 421 and spinner 483 rotate at the same speed.

Positioned adjacent member 421 is a lower tape drive assembly 560 (see FIGS. 4–8). As previously discussed, tape 36 is fed horizontally from top feed assembly 325 and oriented in a vertically downward direction of travel by tape guide block 350. Tape guide 352 conducts the tape 36 over gripping tab forming mechanism 360 where gripping tabs 38 are formed along the length of the tape 36. Located below the tab forming mechanism 360 is another tape guide block 355 adjustably secured to a plate 565 by a fastener 355*a*. The block 355 reorients the tape 36 in a horizontal direction of travel for feeding onto the lower tape drive assembly 560. The lower tape drive assembly 560 intermittently pulls tape 36 along tape guide 352 and applies it directly to the wrapping member 421.

Figure 6:
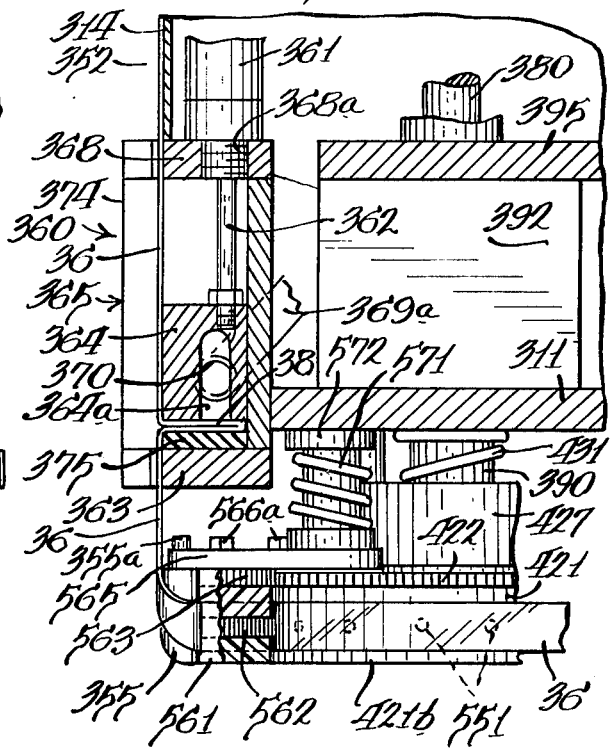
FIG. 6 is a fragmentary cross-sectional view illustrating the position of the tab forming mechanism in a fully extended position.
Figure 7:
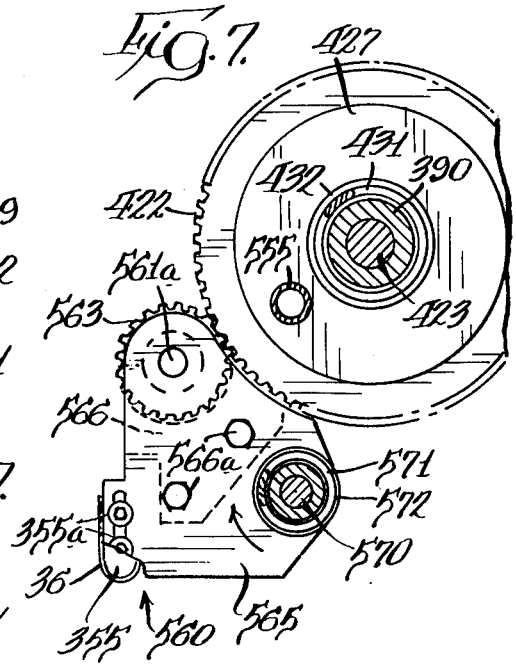
FIG. 7 is a cross-sectional view taken generally along line 7—7 of FIG. 5.

The lower tape drive assembly 560 consists of a cylindrical feed wheel 561 having a knurled cylindrical surface 562 about which the adhesive side of tape 36 passes. The upper end of the feed wheel 561, as viewed in FIGS. 5 and 6, is provided with a gear 563 adapted to mesh with gear 422 on wrapping member 421. The feed wheel 561 freely rotates on a shaft 561*a* threadably attached to the plate 565 as indicated at 561*b* (FIG. 8). The plate 565 in turn is pivotally connected to the lower surface of the base plate 311 by a torsion spring assembly 570 including a torsion spring 571 fitted on a flanged shaft 572. The feed wheel 561 is held in contiguous engagement with the wrapping member 421 such that gear 563 is meshed with gear 422 by the pressure applied by the torsion spring assembly 570, but which can be separated therefrom for insertion or removal of tape 36 therebetween. The feed wheel 561 is powered by the gear 563, which rotates when the member 421 rotates, to feed tape 36 around the knurled surface 562 and onto member 421 so that the non-adhesive side of tape 36 is positioned against the cylindrical surface of member 421. A guide block 566, attached to plate 565 by fasteners 566*a*, is positioned adjacent a portion of the feed wheel to prevent tape 36 from accidentally wrapping around the feed wheel. It is noted that wrapping head 420 is arranged so that tape travels on an arc around a portion of the cylindrical surface of wrapping member 421 between lower tape drive 560 and container 34. Curved slot 556 in cam block 427 is positioned so that vacuum is present at ports 551 over this arc.

Figure 16:
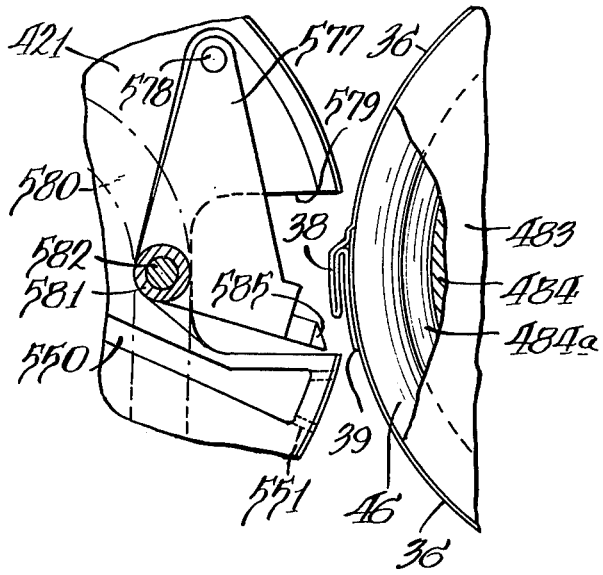
FIG. 16 is a fragmentary view like FIGS. 14 and 15 and showing the container after the secondary closure has been wrapped on the container.

Turning now to FIGS. 14–16, wrapping head 420 is additionally provided with a cutter mechanism 575 positioned in a recess 579 in the member 421 for automatically severing tape 36 after a predetermined length of the tape has been transferred by the member 421 onto a container 34. The cutter mechanism 575 consists of a blade 576 pivotally mounted to member 421 by a pivot arm 577 and pin 578. Movement of the blade 576 is controlled by a downwardly opening cam path 580 provided in cam block 427, and a roller 581 extending upright on pivot arm 577 and mounted thereon for free rotation by a shaft 582 secured to the arm 577. As the member 421 rotates, the roller 581 follows the cam path 580 in the stationary cam block 427. The cam path 580 is arranged so that blade 576 remains retracted within the recess 579 (FIG. 14) and is advanced briefly only once during a revolution of the member 421 (FIG. 15). As blade 576 is advanced outwardly from recess 579, the sharpened edge 585 of the blade contacts tape 36 and severs it.

It will be readily observed from the foregoing detailed description of the present invention and in the illustrated embodiment thereof, that numerous variations and modifications may be made without departing from the true spirit and scope of the invention.

We claim:

1. The method of serially forming sealed containers comprising the steps of: intermittently advancing a series of open topped containers along a horizontal processing path; positioning a closure means in sealing engagement with the open top of each container, so that a seam is provided at a level between each closure means and its container; providing a supply of heat shrinkable thermoplastic tape having a tacky side and a non-tacky side; intermittently feeding along a tape path predetermined lengths of tape from said supply each length having a dimension greater than the peripheral dimension of said container at the level of said seam; said feeding operation includes the steps of applying a transverse force to each tape length by drawing a portion of each tape by suction adjacent one end thereof during dwell periods of tape advancement to deflect a portion of said tape length out of said tape path and place adjacent portions of the tacky side of the tape in face-to-face relationship with respect to one another in a tab formation chamber located in back the non-tacky side of said tape along said tape path; compressing the facing adjacent portions of each tape segment toward and into surface-to-surface adherent engagement with one another in said tab formation chamber during said dwell periods to form a tab; feeding each length of tape with said tab between a feed roll and a tape wrapping head with the tacky side thereof facing said feed roll; and severing each tape length from the supply of tape outwardly of said tab to provide a tape segment having a free tape end beyond said tab; elevating said container to position its seam in a tangential relationship with respect to said tape wrapping head and wrapping each tape segment after the feeding operation about a container at the level of its seam, with the tacky side of said tape facing said container during a dwell period of container advancement by rotating the container about its own axis, whereby said tape segment is positioned in adhesive engagement with a container and its closure means, and said free end is positioned in overlapping adhesive engagement with an opposite end of the tape segment, said folded portions defining an integral gripping tab to facilitate removal of said tape segment from said container and said free end preventing premature removal of said tape segment and applying heat to said tape during the rotation of the container to shrink the same into tight engagement with said container and closure means.

2. The method according to claim 1, wherein the heating step includes: providing a source of heated air; directing said heated air towards the tape on said container; and rotating said container so that the heated air is evenly applied to said tape on said container.

3. The method according to claim 1, wherein the step of feeding tape segments is performed by feeding said segments in interconnected end-to-end relationship, and further including: providing a cutter blade in said tape head; projecting said cutter blade outwardly from said tape head to sever a tape segment from said supply of tape.

4. The method according to claim 1 wherein said step of directing heated air is performed by discharging heated air along an arcuate path generally concentric with said container.

5. Apparatus for providing a secondary closure for open-top lidded containers comprising: intermittently driven conveyor means for moving filled open-topped containers along a horizontal path; means along said path for placing a lid in the open top of each of said filled containers to thereby form a primary closure, said lids having a downwardly extending peripheral skirt embracing the upper end of a container sidewall, thereby forming a seam between the lower end of the skirt and a container sidewall; a supply of heat-shrinkable thermoplastic tape having adhesive on only one side thereof; means for intermittently feeding tape from said supply along a tape feed path; a vacuum chamber adjacent said tape feed path, said vacuum chamber having an open side facing the non-adhesive side of said tape, a source of vacuum connected to said chamber for causing a U-shaped length of tape to be drawin into said chamber during dwell periods of tape advancement; plunger means mounted for movement in said chamber to press said U-shaped length of tape together causing the adhesive surface thereof to adhere to one another to form a tab; means for reciprocating said plunger means during dwell periods of tape advancement; means operable during dwell periods of container advancement for wrapping said tape around container such that a first portion of the tape is adhesively secured to the said downwardly extending peripheral skirt and a second portion of said tape is adhesively secured to the sidewall of the container; means for severing said tape from said supply at a location spaced from said tab and at a length sufficient to allow the tape to be wrapped around the containers and slightly overlap, such that the outer overlapping end is adhesively secured to an underlying portion of the tape; said wrapping means including a rotatable wrapping head; means at a fixed location for elevating a container to position its seam in tangential contact with said rotatable wrapping head; means for rotating said container about its own axis at said fixed location; said means for severing said tape is mounted within said rotatable wrapping head; and means for heat-shrinking the tape wrapped on the container into compressive engagement with said skirt and sidewall, whereby said heat-shrunken length of adhesively secured tape provides a secondary closure.

6. Apparatus according to claim 5, wherein said wrapping means includes feed roll means in contact with the adhesive side of said tape for guiding the non-adhesive side of said tape into engagement with the external cylindrical surface of said tape head, said tape head having a plurality of passageways therein extending radially outward and opening on said external cylindrical surface; a source of vacuum connected to said tape head; and means for intermittently rotating said tape head to establish communication between said vacuum source and said passageways, whereby said tape is removably attached to said tape head with the adhesive side of the tape facing outwardly for transfer of the tape onto a container.

7. Apparatus according to claim 6, wherein said severing means in said wrapping head further includes a cutter blade assembly pivotally mounted to said head; cam means fixedly positioned on said head; and cam follower means on said cutter blade assembly for causing the cutter blade assembly to sever the tape in response to the rotation of the head.

8. Apparatus according to claim 7, wherein said cam means is a cam member having an internal cam track, and said cam follower means is a roller projecting from said cutter blade assembly and into said track.

9. Apparatus according to claim 7, in which said cutter blade assembly includes a pivotally mounted arm having a cutter blade fixed thereon, said blade being movable along an arc having at least one of said passages on each side thereof, whereby the vacuum at the passages of each side of the cutter blade serve to positively hold the tape on opposite sides of the line of severance.

10. Apparatus according to claim 6, wherein said vacuum source is present over a substantial portion of the arc between the locations where the tape first engages the tape head and the container, a plurality of adjacent radial passageways being in communication with said vacuum source as said tape head moves along said arc.

11. Apparatus according to claim 10, wherein said wrapping means includes further passage means vented to atmosphere beyond the arc of said vacuum source to facilitate transfer of said tape from said tape head to a container.

12. Apparatus according to claim 10 wherein said feed roll is located adjacent said wrapping head in a position spaced circumferentially from a container, the external surface of said feed roll having means providing limited surface engagement with the adhesive side of said tape for feeding the non-adhesive side of said tape against the outer cylindrical surface of said wrapping head where the tape is held against a portion of the surface of said tape head by the suction force of the vacuum in said passageways.

13. Apparatus according to claim 6, further including a continuously revolving container rotating assembly.

14. Apparatus according to claim 13, wherein said means for intermittently rotating said tape head includes a single revolution clutch means connected to said tape head, and means for actuating the clutch means in response to movement of said container into engagement with said container rotating assembly.

15. Apparatus according to claim 14, wherein said single revolution clutch means includes a cam member having a stop surface thereon and a pivotally mounted cam follower having a detent thereon engageable with said stop surface for disengaging said clutch means, and said clutch actuating means includes means for pivoting said cam follower in response to movement of said container into engagement with said container rotating assembly.

16. Apparatus according to claim 5, wherein said heat-shrinking means includes a heating block located adjacent to the seam of a container when the container is positioned adjacent the tape wrapping means, said heating block having a plurality of air ports directed towards the tape on said container; means establishing communication between said air ports and a source of air; and said heating block including means for heating air flowing through said air ports.

* * * * *